US012409492B2

(12) United States Patent
Zhang et al.

(10) Patent No.: US 12,409,492 B2
(45) Date of Patent: Sep. 9, 2025

(54) PREPARATION METHOD OF COPPER FOAM

(71) Applicant: AAC Technologies (Nanjing) Co., Ltd., Nanjing (CN)

(72) Inventors: Bo Zhang, Shenzhen (CN); Guochuang Huang, Shenzhen (CN)

(73) Assignee: AAC Technologies (Nanjing) Co., Ltd., Nanjing (CN)

( * ) Notice: Subject to any disclaimer, the term of this patent is extended or adjusted under 35 U.S.C. 154(b) by 0 days.

(21) Appl. No.: 17/922,979

(22) PCT Filed: Jul. 20, 2022

(86) PCT No.: PCT/CN2022/106643
§ 371 (c)(1),
(2) Date: Nov. 3, 2022

(87) PCT Pub. No.: WO2024/000684
PCT Pub. Date: Jan. 4, 2024

(65) Prior Publication Data

US 2025/0114841 A1 Apr. 10, 2025

(30) Foreign Application Priority Data

Jun. 30, 2022 (CN) ..... 202210765359.2

(51) Int. Cl.
*B22F 3/11* (2006.01)
*B22F 3/10* (2006.01)

(52) U.S. Cl.
CPC ..... *B22F 3/1125* (2013.01); *B22F 3/1021* (2013.01); *B22F 2003/1131* (2013.01); *B22F 2301/10* (2013.01); *B22F 2304/058* (2013.01)

(58) Field of Classification Search
CPC ..... B22F 3/1125; B22F 3/1021; B22F 2003/1131; B22F 2301/10; B22F 2304/058
See application file for complete search history.

(56) References Cited

U.S. PATENT DOCUMENTS

2021/0154739 A1* 5/2021 Kim ..... B22F 7/008

FOREIGN PATENT DOCUMENTS

EP 0765704 A2 * 4/1997 ..... B22F 3/225

* cited by examiner

*Primary Examiner* — Ricardo D Morales
(74) *Attorney, Agent, or Firm* — Wiersch Law Group

(57) ABSTRACT

A preparation method of copper foam includes coating copper paste on a release film to form a coating sheet with a thickness of 50-200 μm on the release film, peeling off the release film to obtain a copper foam preform after drying the release film with the coating sheet, and performing a glue discharging process on the copper foam preform and sintering the copper foam preform to obtain the copper foam having a thickness of 30-120 μm and having a porosity of 50-80%. The thickness of the copper foam is reduced, which ensures a balance between the porosity and a structural strength of the copper foam, so the copper foam has a good water absorption performance, and a heat dissipation performance of the copper foam is effectively improved.

9 Claims, 1 Drawing Sheet

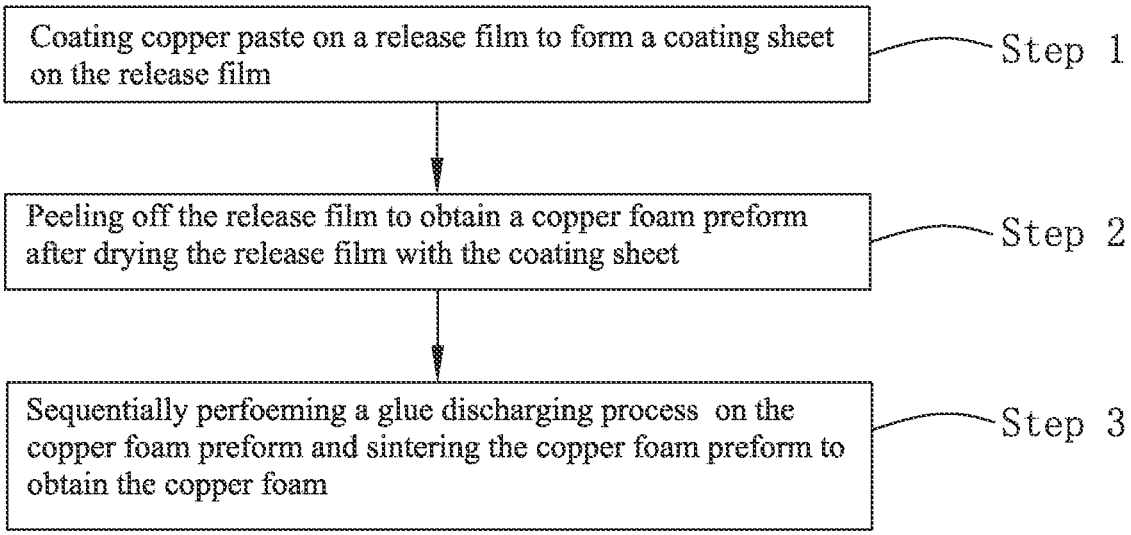
Coating copper paste on a release film to form a coating sheet on the release film
Step 1
Peeling off the release film to obtain a copper foam preform after drying the release film with the coating sheet
Step 2
Sequentially perfoeming a glue discharging process on the copper foam preform and sintering the copper foam preform to obtain the copper foam
Step 3

PREPARATION METHOD OF COPPER FOAM

TECHNICAL FIELD

The present disclosure relates to a preparation method of a heat dissipating material, and in particular to a preparation method of copper foam.

BACKGROUND

With high-frequency and high-speed development of electronic components and integrated circuit technology, a volume of the electronic products becomes smaller and smaller, resulting in generation of a large amount of heat in the electronic products during an operation of the electronic components installed in the electronic products. For example, a heat flux density during an operation of a CPU of a computer is as high as 60-100 W/cm$^2$. High heat flow poses a great threat to reliability of a normal operation of the electronic components, so heat dissipation has become a key issue in development of miniaturization of the electronic products. In order to ensure the normal operation of the electronic components, a radiator is generally installed on the electronic components to dissipate heat. Meanwhile, a vapor chamber with good thermal conductivity is installed between the radiator and the electronic components to distribute the heat generated by the electronic components evenly. Then the heat is conducted to the radiator and is dissipated by the radiator.

The vapor chamber is a thermally conductive component that realizes rapid heat transfer by phase change of internal working fluid of the vapor chamber. The vapor chamber mainly comprises an upper cover plate, a lower cover plate (or metal tubes), a sealing head, a liquid absorbing wick, and a heat transfer medium. A capillary structure of the liquid absorbing wick directly affect a performance of the vapor chamber. The capillary structure has strong capillary force and low resistance to water flow. In the prior art, there are many kinds of liquid absorbing wicks with the capillary structure, such as copper foam, copper mesh, composite copper mesh, and etched capillary structure.

With continuous development of the miniaturization of the electronic products, sizes of the electronic components thereof are required to become smaller and thinner, which makes a thickness requirement of the vapor chamber stringent. As a result, an ultra-thin vapor chamber with a thickness less than 280 μm (such as 240 μm) came into being. The ultra-thin vapor chamber requires a thin liquid absorbing wick while ensuring a good heat transfer performance. Therefore, preparation of a liquid absorbent wick with a thickness of 80 μm (or even 50 μm) is on the agenda.

Therefore, it is necessary to provide a preparation method of ultra-thin copper foam to solve above problems.

SUMMARY

In view of above problems, the present disclosure provides a preparation method of ultra-thin copper foam to prepare the copper foam with small thickness and strong water absorption performance.

To achieve the above purpose, the present disclosure provide a preparation method of copper foam. The preparation method of the copper foam comprises:

coating copper paste on a release film to form a coating sheet on the release film;

peeling off the release film to obtain a copper foam preform after drying the release film with the coating sheet; and sequentially performing a glue discharging process on the copper foam preform and sintering the copper foam preform to obtain the copper foam.

A thickness of the coating sheet range from 50-200 μm. A thickness of the copper foam ranges from 30-120 μm. A porosity of the copper foam is 50-80%.

Optionally, a viscosity of the copper paste ranges from 10000-35000 cps. The copper paste comprises copper powder, a binder, a pore forming agent, a solvent, a tackifier, a dispersant, a leveling agent, and an antioxidant.

Optionally, an average particle size of the copper powder is 0.5-10 μm, and a median particle size of the copper powder is 3 μm.

Optionally, during a process of sintering the copper foam preform, a sintering temperature range from 650-1050° C., sintering time ranges from 0.5-24 h, and a sintering atmosphere is ammonia gas.

Optionally, during the glue discharging process, a glue discharging temperature ranges from 350-450° C. and a glue discharging atmosphere is nitrogen.

Optionally, the release film is selected from one of polyethyleneterephthalat (PET), polyethylene (PE), and o-phenylphenol (OPP). A thickness of the release film ranges from 75-120 μm.

Optionally, the binder comprises one or more of polyvinyl alcohol (PVA), epoxy resin, acrylic resin, phenolic resin, modified phenolic resin, hydroxymethyl cellulose, and ethyl cellulose. The copper paste comprises 0.1-30 wt % of the binder.

The pore forming agent comprises one or more of ammonium chloride, urea, ammonium sulfate, citric acid, and benzoic acid. The copper paste comprises 5-50 wt % of the pore forming agent.

Optionally, the solvent comprises one or more of ethanol, propanol, isopropanol, acetone, toluene, xylene, terpineol, triethanolamine, isophorone, divalent ester, and water. The copper paste comprises 1-70 wt % of the solvent;

The tackifier comprises one or more of natural rubber, styrene-butadiene rubber, neoprene, C5-type petroleum resin, and C9-type petroleum resin. The copper paste comprises 0.01-5 wt % of the tackifier.

Optionally, the dispersant comprises one or more of methyl amyl alcohol, cellulose derivatives, polyacrylamide, and fatty acid polyethylene glycol ester. The copper paste comprises 0.01-5 wt % of the dispersant.

Optionally, the leveling agent comprises one or more of sodium dodecyl sulfate, sodium dodecylbenzenesulfonate, sodium tetradecylsulfonate, sodium cetylsulfonate, lecithin, triethanolamine, KH550, polyethylene glycol, and triethanolamine. The copper paste comprises 0.01-10 wt % of the leveling agent.

The antioxidant comprises one or more of citric acid, phytic acid, vitamins, oxalic acid, ascorbic acid, and glucose. The copper paste comprises 0.01-10 wt % of the antioxidant.

Compared with the prior art, in the preparation method of the copper foam, the copper paste is coated on the release film to form the coating sheet with the thickness of 50-200 μm on the release film, the release film is peeled off to obtain the copper foam preform after drying the release film with the coating sheet, and the gas generated by the copper foam preform is discharged and the copper foam preform sintered to obtain the copper foam having the thickness of 30-120 μm and having the porosity of 50-80%. The thickness of the copper foam prepared by the present disclosure is reduced, which ensures a balance between the porosity and a structural strength of the copper foam, so the copper foam has a good water absorption performance, and a heat dissipation performance of the copper foam is effectively improved.

BRIEF DESCRIPTION OF DRAWINGS

FIG. 1 is a flow chart of a preparation method of copper foam of the present disclosure.

DETAILED DESCRIPTION

Technical solutions of the present disclosure will be clearly and completely described below with reference to accompanying drawings and specific embodiments.

As shown in FIG. 1, the present disclosure provide a preparation method of copper foam. The preparation method of the copper foam comprises following steps:

Step 1: coating copper paste on a release film to form a coating sheet on the release film;

Step 2: peeling off the release film to obtain a copper foam preform after drying the release film with the coating sheet; and Step 3: sequentially performing a glue discharging process on the copper foam preform and sintering the copper foam preform to obtain the copper foam.

In the step 1, the copper paste comprises copper powder, a binder, a pore forming agent, a solvent, a tackifier, a dispersant, a leveling agent, and an antioxidant.

An average particle size of the copper powder is 0.5-10 μm, and a median particle size of the copper powder is 3 μm. Specifically, the copper powder with wide distribution and fine particle size of the present disclosure can fully contact other materials during a sintering process, which ensures that the copper foam of the present disclosure has high structural strength while having a thin thickness.

The binder comprises one or more of polyvinyl alcohol (PVA), epoxy resin, acrylic resin, phenolic resin, modified phenolic resin, hydroxymethyl cellulose, and ethyl cellulose.

The pore forming agent comprises one or more of ammonium chloride, urea, ammonium sulfate, citric acid, and benzoic acid.

The solvent comprises one or more of ethanol, propanol, isopropanol, acetone, toluene, xylene, terpineol, triethanolamine, isophorone, divalent ester, and water.

The tackifier comprises one or more of natural rubber, styrene-butadiene rubber, neoprene, C5-type petroleum resin, and C9-type petroleum resin.

The dispersant comprises one or more of methyl amyl alcohol, cellulose derivatives, polyacrylamide, and fatty acid polyethylene glycol ester.

The leveling agent comprises one or more of sodium dodecyl sulfate, sodium dodecylbenzenesulfonate, sodium tetradecylsulfonate, sodium cetylsulfonate, lecithin, triethanolamine, KH550, polyethylene glycol, and triethanolamine.

The antioxidant comprises one or more of citric acid, phytic acid, vitamins, oxalic acid, ascorbic acid, and glucose.

After above raw materials are selected, the pore forming agent is put into a ball mill for grinding for 4-24 hours or is pulverized by a pulverizer to obtain the pore forming agent with the particle size of 20-200 μm. Then, the copper powder and the sieved pore forming agent are placed in a mixer and are fully mixed for 1-12 h to obtain mixed powder. Then, the solvent, the binder, the dispersant, the leveling agent, the tackifier, and the antioxidant are added to the mixed powder and are fully mixed in the mixer for 0.5-12 h to obtain the copper paste with a viscosity of 10000-35000 cps. The copper paste comprises a certain amount of copper power, 0.1-30 wt % of the binder, 5-50 wt % of the pore forming agent, 1-70 wt % of the solvent, 0.01-5 wt % of the tackifier, 0.01-5 wt % of the dispersant, 0.01-10 wt % of the leveling agent, and 0.01-10 wt % of the antioxidant.

After the copper paste is prepared, the copper paste is coated on the release film by scrape coating or screen printing, so as to form the coating sheet with the thickness of 50-200 μm on the release film. Specifically, the release film is selected from one of polyethyleneterephthalat (PET), polyethylene (PE), and o-phenylphenol (OPP). A thickness of the release film ranges from 75-120 μm to ensure that the release film coated with the coating sheet does not soften or be seriously deformed in a subsequent sintering process. Optionally, the thickness of the release film is 120 μm, which is an upper limit value.

In the step 2, a drying process is generally carried out in a tunnel furnace or an oven. Rise and fall of the temperature is controlled by a program, which ensures that the coating sheet on the release film does not crack in the drying process and a subsequent peeling process. Thus, a complete copper foam preform is obtained. Specifically, the drying process is generally carried out in the oven.

In the step 3, during the glue discharging process, a glue discharging temperature ranges from 350-450° C. and a glue discharging atmosphere is nitrogen. During the glue discharging process, the binder and the pore forming agent are volatilized. In order to ensure uniformity of a structure of the copper foam, the glue discharging temperature during the glue discharging process needs to be controlled at a same temperature range. During the glue discharging process, a certain amount of gas is generated. In order to ensure uniformity of a top surface and a bottom surface of the prepared copper foam, it is necessary to have air flow on the top surface and the bottom surface of the copper foam. Therefore, during the glue discharging process, the copper foam preform needs to be placed on a ceramic with a porous structure or a quartz glass with a porous structure for gas discharge, which also prevents the copper foam preform from sticking to the ceramic configured as a carrier plate or the quartz glass configured as the carrier plate. In addition, since a large amount of exhaust gas is generated during the glue discharging process, a device for discharging the binder and the pore forming agent should be equipped with an exhaust gas absorption device. Generally, the glue discharging process is carried out in a sintering furnace.

After the glue discharging process is performed on the copper foam preform, the copper foam preform is sintered. A sintering temperature range from 650-1050° C., sintering time ranges from 0.5-24 h, and a sintering atmosphere is ammonia gas. Specifically, in the embodiment, the sintering temperature ranges from 700-900° C., and the sintering time ranges from 2-12 hours. The copper foam with a thickness of 30-120 μm and a porosity of 50-80% is obtained after the glue discharging process is completed and the copper foam preform is sintered.

It is understood that in order to control a balance between the porosity and a structural strength of the prepared copper foam, the sintering temperature and the sintering time are adjusted.

The preparation method of the copper foam provided by the present disclosure is further described by following specific embodiments.

Embodiment 1

The copper powder with the average particle size of 10 μm and ammonium chloride particles are mixed according to a mass ratio of 3:1 to obtain the mixed powder, The ammonium chloride particles have a particle size of 70-100 μm and are obtained by ball milling or crushing and sieving. Xylene solution with a concentration of 25% is added to the mixed powder and is mixed with the mixed powder. Then 0.5 wt % tackifier, 0.5 wt % dispersant, 1 wt % antioxidant, and a certain amount of the leveling agent are added in turn and are stirred for 0.5-6 h to obtain the copper paste. The copper paste is scrapped onto a PET release film with a thickness of 150 μm to form the coating sheet. The PET release film with the coating sheet is put into the oven for drying at 90-110° C. for 20 min. Then the PET release film is peeled off from the coating sheet to obtain the copper foam preform. The copper foam preform is put into the sintering furnace, the sintering furnace is firstly fed with $N_2$, and the glue discharging process is performed at 400° C. for 90 min. Then the sintering furnace is fed with the ammonia gas, and the copper foam preform is sintered at 700-850° C. for 120 min. Finally, the copper foam with the thickness of 90=10 μm and with a porous capillary structure is obtained.

Embodiment 2

The copper powder with the average particle size of 1 μm and ammonium chloride particles are mixed according to the mass ratio of 3:1 to obtain mixed powder, The ammonium chloride particles have the particle size of 70-100 μm and are obtained by ball milling or crushing and sieving. The xylene solution with the concentration of 25% is added to the mixed powder and is mixed with the mixed powder. Then 0.5 wt % tackifier, 0.5 wt % dispersant, 1 wt % antioxidant, and a certain amount of the leveling agent are added in turn and are stirred for 0.5-6 h to obtain the copper paste. The copper paste is scrapped onto the PET release film with the thickness of 120 μm to form the coating sheet. The PET release film with the coating sheet is put into the oven for drying at 90-110° C. for 30 min. Then the PET release film is peeled off from the coating sheet to obtain the copper foam preform. The copper foam preform is put into the sintering furnace, the sintering furnace is firstly fed with $N_2$, and the glue discharging process is performed at 400° C. for 90 min. Then the sintering furnace is fed with the ammonia gas, and the copper foam preform is sintered at 700-850° C. for 90 min. Finally, the copper foam with the thickness of 75+10 μm and with the porous capillary structure is obtained.

Embodiment 3

The copper powder with the average particle size of 10 μm and ammonium chloride particles are mixed according to a mass ratio of 2:1 to obtain mixed powder, The ammonium chloride particles have the particle size of 70-100 μm and are obtained by ball milling or crushing and sieving. The xylene solution with the concentration of 25% is added to the mixed powder and is mixed with the mixed powder. Then 0.5 wt % tackifier, 0.5 wt % dispersant, 1 wt % antioxidant, and a certain amount of the leveling agent are added in turn and are stirred for 0.5-6 h to obtain the copper paste. The copper paste is scrapped onto the PET release film with the thickness of 100 μm to form the coating sheet. The PET release film with the coating sheet is put into the oven for drying at 90-110° C. for 20 min. Then the PET release film is peeled off from the coating sheet to obtain the copper foam preform. The copper foam preform is put into the sintering furnace, the sintering furnace is firstly fed with $N_2$, and the glue discharging process is performed at 400° C. for 90 min. Then the sintering furnace is fed with the ammonia gas, and the copper foam preform is sintered at 700-850° C. for 120 min. Finally, the copper foam with the thickness of 70±10 μm and with the porous capillary structure is obtained.

Embodiment 4

The copper powder with the average particle size of 1 μm and ammonium chloride particles are mixed according to the mass ratio of 2:1 to obtain mixed powder, The ammonium chloride particles have the particle size of 70-100 μm and are obtained by ball milling or crushing and sieving. The xylene solution with the concentration of 25% is added to the mixed powder and is mixed with the mixed powder. Then 0.5 wt % tackifier, 0.5 wt % dispersant, 1 wt % antioxidant, and a certain amount of the leveling agent are added in turn and are stirred for 0.5-6 h to obtain the copper paste. The copper paste is scrapped onto the PET release film with the thickness of 80 μm to form the coating sheet. The PET release film with the coating sheet is put into the oven for drying at 90-110° C. for 20 min. Then the PET release film is peeled off from the coating sheet to obtain the copper foam preform. The copper foam preform is put into the sintering furnace, the sintering furnace is firstly fed with $N_2$, and the glue discharging process is performed at 400° C. for 90 min. Then the sintering furnace is fed with the ammonia gas, and the copper foam preform is sintered at 700-850° C. for 120 min. Finally, the copper foam with the thickness of 50±8 μm and with the porous capillary structure is obtained.

Embodiment 5

The copper powder with the average particle size of 10 μm and ammonium chloride particles are mixed according to a mass ratio of 1:1 to obtain mixed powder, The ammonium chloride particles have the particle size of 70-100 μm and are obtained by ball milling or crushing and sieving. The xylene solution with the concentration of 25% is added to the mixed powder and is mixed with the mixed powder. Then 0.5 wt % tackifier, 0.5 wt % dispersant, 1 wt % antioxidant, and a certain amount of the leveling agent are added in turn and are stirred for 0.5-6 h to obtain the copper paste. The copper paste is scrapped onto the PET release film with the thickness of 70 μm to form the coating sheet. The PET release film with the coating sheet is put into the oven for drying at 90-110° C. for 20 min. Then the PET release film is peeled off from the coating sheet to obtain the copper foam preform. The copper foam preform is put into the sintering furnace, the sintering furnace is firstly fed with $N_2$, and the glue discharging process is performed at 450° C. for 90 min. Then the sintering furnace is fed with the ammonia gas, and the copper foam preform is sintered at 700-850° C. for 120 min. Finally, the copper foam with the thickness of 45±5 μm and with the porous capillary structure is obtained.

Embodiment 6

The copper powder with the average particle size of 1 μm and ammonium chloride particles are mixed according to the mass ratio of 1:1 to obtain mixed powder, The ammonium chloride particles have the particle size of 70-100 μm and are obtained by ball milling or crushing and sieving. The xylene solution with the concentration of 25% is added to the mixed powder and is mixed with the mixed powder. Then 0.5 wt % tackifier, 0.5 wt % dispersant, 1 wt % antioxidant, and a certain amount of the leveling agent are added in turn and are stirred for 0.5-6 h to obtain the copper paste. The copper paste is scrapped onto the PET release film with the thickness of 60 μm to form the coating sheet. The PET release film with the coating sheet is put into the oven for drying at 90-110° C. for 20 min. Then the PET release film is peeled off from the coating sheet to obtain the copper foam preform. The copper foam preform is put into the sintering furnace, the sintering furnace is firstly fed with $N_2$, and the glue discharging process is performed at 450° C. for 90 min. Then the sintering furnace is fed with the ammonia gas, and the copper foam preform is sintered at 700-850° C. for 120 min. Finally, the copper foam with the thickness of 45±5 μm and with the porous capillary structure is obtained.

Embodiment 7

The copper powder with the average particle size of 1 μm and ammonium chloride particles are mixed according to the mass ratio of 3:1 to obtain mixed powder, The ammonium chloride particles have the particle size of 70-100 μm and are obtained by ball milling or crushing and sieving. The xylene solution with a concentration of 20% is added to the mixed powder and is mixed with the mixed powder. Then 0.5 wt % tackifier, 0.5 wt % dispersant, 1 wt % antioxidant, and a certain amount of the leveling agent are added in turn and are stirred for 0.5-6 h to obtain the copper paste. The copper paste is scrapped onto the PET release film with the thickness of 50 μm to form the coating sheet. The PET release film with the coating sheet is put into the oven for drying at 90-110° C. for 30 min. Then the PET release film is peeled off from the coating sheet to obtain the copper foam preform. The copper foam preform is put into the sintering furnace, the sintering furnace is firstly fed with $N_2$, and the glue discharging process is performed at 400° C. for 90 min. Then the sintering furnace is fed with the ammonia gas, and the copper foam preform is sintered at 700-850° C. for 120 min. Finally, the copper foam with the thickness of 308 μm and with the porous capillary structure is obtained.

Embodiment 8

The copper powder with the average particle size of 1 μm and ammonium chloride particles are mixed according to a mass ratio of 5:2 to obtain mixed powder, The ammonium chloride particles have the particle size of 70-100 μm and are obtained by ball milling or crushing and sieving. The xylene solution with the concentration of 20% is added to the mixed powder and is mixed with the mixed powder. Then 0.5 wt % tackifier, 0.5 wt % dispersant, 1 wt % antioxidant, and a certain amount of the leveling agent are added in turn and are stirred for 0.5-6 h to obtain the copper paste. The copper paste is scrapped onto the PET release film with the thickness of 50 μm to form the coating sheet. The PET release film with the coating sheet is put into the oven for drying at 90-110° C. for 30 min. Then the PET release film is peeled off from the coating sheet to obtain the copper foam preform. The copper foam preform is put into the sintering furnace, the sintering furnace is firstly fed with $N_2$, and the glue discharging process is performed at 400° C. for 90 min. Then the sintering furnace is fed with the ammonia gas, and the copper foam preform is sintered at 850-900° C. for 120 min. Finally, the copper foam with the thickness of 30±5 μm and with the porous capillary structure is obtained.

Embodiment 9

The copper powder with the average particle size of 1 μm and ammonium chloride particles are mixed according to a mass ratio of 2:1 to obtain mixed powder, The ammonium chloride particles have the particle size of 70-100 μm and are obtained by ball milling or crushing and sieving. The xylene solution with the concentration of 20% is added to the mixed powder and is mixed with the mixed powder. Then 0.5 wt % tackifier, 0.5 wt % dispersant, 1 wt % antioxidant, and a certain amount of the leveling agent are added in turn and are stirred for 0.5-6 h to obtain the copper paste. The copper paste is scrapped onto the PET release film with the thickness of 60 μm to form the coating sheet. The PET release film with the coating sheet is put into the oven for drying at 90-110° C. for 30 min. Then the PET release film is peeled off from the coating sheet to obtain the copper foam preform. The copper foam preform is put into the sintering furnace, the sintering furnace is firstly fed with $N_2$, and the glue discharging process is performed at 450° C. for 90 min. Then the sintering furnace is fed with the ammonia gas, and the copper foam preform is sintered at 850-900° C. for 120 min. Finally, the copper foam with the thickness of 40±5 μm and with porous capillary structure is obtained.

Embodiment 10

The copper powder with the average particle size of 1 μm and ammonium chloride particles are mixed according to a mass ratio of 2.5:1 to obtain mixed powder, The ammonium chloride particles have the particle size of 70-100 μm and are obtained by ball milling or crushing and sieving. The xylene solution with the concentration of 20% is added to the mixed powder and is mixed with the mixed powder. Then 0.5 wt % tackifier, 0.5 wt % dispersant, 1 wt % antioxidant, and a certain amount of the leveling agent are added in turn and are stirred for 0.5-6 h to obtain the copper paste. The copper paste is scrapped onto the PET release film with the thickness of 60 μm to form the coating sheet. The PET release film with the coating sheet is put into the oven for drying at 90-110° C. for 30 min. Then the PET release film is peeled off from the coating sheet to obtain the copper foam preform. The copper foam preform is put into the sintering furnace, and the sintering furnace is firstly fed with $N_2$, and the glue discharging process is performed at 450° C. for 90 min. Then the sintering furnace is fed with the ammonia gas, and the copper foam preform is sintered at 850-900° C. for 120 min. Finally, the copper foam with the thickness of 45±5 μm and with the porous capillary structure is obtained.

Compared with the prior art, in the preparation method of the copper foam, the copper paste is coated on the release film to form the coating sheet with the thickness of 50-200 μm on the release film, the release film is peeled off to obtain the copper foam preform after drying the release film with the coating sheet, and the gas generated by the copper foam preform is discharged and the copper foam preform sintered to obtain the copper foam having the thickness of 30-120 μm and having the porosity of 50-80%. The thickness of the copper foam prepared by the present disclosure is reduced, which ensures a balance between the porosity and a structural strength of the copper foam, so the copper foam has a good water absorption performance, and a heat dissipation performance of the copper foam is effectively improved.

The above are only the embodiments of the present disclosure. It should be pointed out that for those of ordinary skill in the art, improvements can be made without departing from the inventive concept of the present disclosure, and these improvements fall within the protection scope of the present disclosure.

What is claimed is:

1. A preparation method of copper foam, comprising:

coating copper paste on a release film to form a coating sheet on the release film;

peeling off the release film to obtain a copper foam preform after drying the release film with the coating sheet; and sequentially performing a glue discharging process on the copper foam preform and sintering the copper foam preform to obtain the copper foam;

wherein a thickness of the coating sheet range from 50-200 μm; a thickness of the copper foam ranges from 30-120 μm; a porosity of the copper foam is 50-80%;

wherein a viscosity of the copper paste ranges from 10000-35000 cps; the copper paste comprises copper powder, a binder, a pore forming agent, a solvent, a tackifier, a dispersant, a leveling agent, and an antioxidant.

2. The preparation method of the copper foam according to claim 1, wherein an average particle size of the copper powder is 0.5-10 μm, and a median particle size of the copper powder is 3 μm.

3. The preparation method of the copper foam according to claim 1, wherein during a process of sintering the copper foam preform, a sintering temperature range from 650-1050° C., sintering time ranges from 0.5-24 h, and a sintering atmosphere is ammonia gas.

4. The preparation method of the copper foam according to claim 1, wherein during the glue discharging process, a glue discharging temperature ranges from 350-450° C. and a glue discharging atmosphere is nitrogen.

5. The preparation method of the copper foam according to claim 1, wherein the release film is selected from one of polyethyleneterephthalat (PET), polyethylene (PE), and o-phenylphenol (OPP); a thickness of the release film ranges from 75-120 μm.

6. The preparation method of the copper foam according to claim 1, wherein the binder comprises one or more of polyvinyl alcohol (PVA), epoxy resin, acrylic resin, phenolic resin, modified phenolic resin, hydroxymethyl cellulose, and ethyl cellulose; the copper paste comprises 0.1-30 wt % of the binder;

wherein the pore forming agent comprises one or more of ammonium chloride, urea, ammonium sulfate, citric acid, and benzoic acid; the copper paste comprises 5-50 wt % of the pore forming agent.

7. The preparation method of the copper foam according to claim 1, wherein the solvent comprises one or more of ethanol, propanol, isopropanol, acetone, toluene, xylene, terpineol, triethanolamine, isophorone, divalent ester, and water; the copper paste comprises 1-70 wt % of the solvent;

wherein the tackifier comprises one or more of natural rubber, styrene-butadiene rubber, neoprene, C5-type petroleum resin, and C9-type petroleum resin; the copper paste comprises 0.01-5 wt % of the tackifier.

8. The preparation method of the copper foam according to claim 1, wherein the dispersant comprises one or more of methyl amyl alcohol, cellulose derivatives, polyacrylamide, and fatty acid polyethylene glycol ester; the copper paste comprises 0.01-5 wt % of the dispersant.

9. The preparation method of the copper foam according to claim 1, wherein the leveling agent comprises one or more of sodium dodecyl sulfate, sodium dodecylbenzenesulfonate, sodium tetradecylsulfonate, sodium cetylsulfonate, lecithin, triethanolamine, KH550, polyethylene glycol, and triethanolamine; the copper paste comprises 0.01-10 wt % of the leveling agent;

wherein the antioxidant comprises one or more of citric acid, phytic acid, vitamins, oxalic acid, ascorbic acid, and glucose; the copper paste comprises 0.01-10 wt % of the antioxidant.

* * * * *